US012415122B2

(12) United States Patent
Gaine et al.

(10) Patent No.: US 12,415,122 B2
(45) Date of Patent: Sep. 16, 2025

(54) RECREATIONAL GAME AND METHOD OF PLAYING THE SAME

(71) Applicant: WICKED JESTER GAMES, LLC, Fishkill, NY (US)

(72) Inventors: Edward Gaine, Windsor, CT (US); Steven Ellis, Windsor, CT (US)

(73) Assignee: Wicked Jester Games, LLC, Fishkill, NY (US)

( * ) Notice: Subject to any disclaimer, the term of this patent is extended or adjusted under 35 U.S.C. 154(b) by 659 days.

(21) Appl. No.: 17/875,087

(22) Filed: Jul. 27, 2022

(65) Prior Publication Data

US 2023/0066198 A1 Mar. 2, 2023

Related U.S. Application Data

(60) Provisional application No. 63/238,375, filed on Aug. 30, 2021.

(51) Int. Cl.

| | |
|---|---|
| ***A63B 67/06*** | (2006.01) |
| ***A63B 67/00*** | (2006.01) |
| ***A63B 71/02*** | (2006.01) |
| ***A63B 71/06*** | (2006.01) |

(52) U.S. Cl.

CPC ..... *A63B 67/06* (2013.01); *A63B 67/002* (2013.01); *A63B 71/023* (2013.01); *A63B 71/0605* (2013.01); *A63B 71/0622* (2013.01); *A63B 71/0669* (2013.01); *A63B 2071/024* (2013.01); *A63B 2071/026* (2013.01); *A63B 2071/0625* (2013.01); *A63B 2225/74* (2020.08)

(58) Field of Classification Search

CPC ..... A63B 67/06; A63B 67/002; A63B 71/023; A63B 71/0605; A63B 71/0622; A63B 71/0669; A63B 2225/74; A63B 2071/024; A63B 2071/026; A63B 2071/0625

USPC ..... 473/470

See application file for complete search history.

(56) References Cited

U.S. PATENT DOCUMENTS

| | | | | |
|---|---|---|---|---|
| 11,331,550 | B1 * | 5/2022 | Showalter | A63B 71/0669 |
| 2018/0021630 | A1 * | 1/2018 | Monnin | A63F 13/235 473/570 |
| 2018/0093151 | A1 * | 4/2018 | Burdan | A63B 71/0672 |
| 2023/0047311 | A1 * | 2/2023 | Hays | A63B 63/007 |

FOREIGN PATENT DOCUMENTS

| | | | | |
|---|---|---|---|---|
| CA | 2944176 | A1 * | 4/2018 | A63B 67/06 |
| CA | 3088632 | A1 * | 1/2022 | A63B 67/06 |

OTHER PUBLICATIONS

"DIY Backyard Quidditch", TheScrapShoppeblog.com (Year: 2018).*
"Bamzball Game W/ 2 CT Balls"; Lifeisbetteroutside.com (Year: 2024).*

* cited by examiner

*Primary Examiner* — Samir Abdosh
(74) *Attorney, Agent, or Firm* — Dinsmore & Shohl LLP

(57) ABSTRACT

A recreational game is disclosed, including at least one flying disc, wherein a player on each of a set of teams throws the flying disc towards two sets of goal rings positioned on opposing sides of one another. The player on each set of teams attempts to throw the flying disc through one of the two sets of rings to obtain a point value. At least one ball is utilized as a defensive element to prevent the flying disc from travelling through one of the rings.

19 Claims, 16 Drawing Sheets

$$R = D_{ring} / D_{disc}$$

RECREATIONAL GAME AND METHOD OF PLAYING THE SAME

CROSS-REFERENCE TO RELATED APPLICATIONS

The present application claims priority to U.S. Provisional Patent Application No. 63/238,375 filed Aug. 30, 2021, entitled "RECREATIONAL GAME AND METHOD OF PLAYING THE SAME," which is hereby incorporated by reference in its entirety.

TECHNICAL FIELD

Embodiments of the invention relate to games and more particularly to a recreational yard game having multiple playing devices and methods of play.

BACKGROUND

A flying disc (e.g., FrisbeeR) is a gliding/flying toy that have been long used for recreational enjoyment from basic throw-and-catch games to disc golf to Ultimate Frisbee™. These flying discs are often constructed using injection-molded plastic and are roughly 8-10 inches in diameter. However, various sizes and configurations exist. Similarly, many games include one or more balls, goals, and other implements that provide an interactive and competitive format for players to play against one another.

SUMMARY OF THE INVENTION

This summary is provided to introduce a variety of concepts in a simplified form that is disclosed further in the detailed description of the embodiments. This summary is not intended to identify key or essential inventive concepts of the claimed subject matter, nor is it intended for determining the scope of the claimed subject matter.

The embodiments provided herein relate to a recreational game, including at least one flying disc, wherein a player on one of a set of two or more competing teams throws the flying disc towards a set of goals comprising multiple rings or hoops (e.g. one to three rings or hoops) positioned on opposite ends of a playing field. The players attempt to throw the flying disc through their team's assigned set of rings when on offense to obtain a score with a specific point value. Additionally, a defensive ball can be thrown by an opposing team member player while on defense and utilized as a defensive element to prevent or block the flying disc from travelling through the ring(s) to prevent the team from scoring.

The game can be played with various numbers of players on each team in different embodiments. Players can alternate throwing the flying disc (e.g. when passing or attempting to score), and scoring is calculated by addition or subtraction/elimination. Scores are tracked in a series of "frames." For each "frame," scores are totaled and play continues until a pre-determined threshold is reached (e.g., 21 points, 100 points). Each ring can provide a varying degree of difficulty, depending on specific variable(s) (e.g. a diameter of the ring). Scoring (by throwing the flying disc through one of the rings) may correspond to a point value, which may change based on the difficulty of throwing the flying disc through each ring. The size of the rings may be changed to provide further gameplay customization. Note: the word "ring" is used interchangeably herein with the word "hoop." In various embodiments, the goal "rings'" shapes can alternatively be triangular, square, diamond, round, or oval shaped, regular or irregular shapes or combinations thereof (e.g., one round ring, one square ring, and one diamond ring per goal set]. Further, dimensions of a playing area may be standardized, or modular, and may be set to accommodate players of various skill levels.

In one aspect, each ring may be in monitored and/or operable communication with an optional electronic scoring system to allow for automated or semi-automated scoring of a match. For example, the scoring system may include one or more sensors positioned on, near, within, around, or remotely from each ring to sense when a flying disc passes through the ring. Once the flying disc passes through a ring, the score can be updated or otherwise changed via a scoring module program stored in computer executable memory and executed by a computer processor or otherwise in operable communication with a computing system.

In another aspect, one or more lighting elements can be positioned on, near, or at each goal ring. Once a flying disc passes through the ring, a state of the lighting elements can be modified such that the lighting elements are turned on (steady or flashing) or off to indicate that a goal has been scored. Additionally, scoring a goal can be coupled with activation of an audible alarm bell or electronic signal/sound. Combinations of audio and visual indicators can also be used.

Alternatively, rings can be made of a transparent plastic material, and include one or more LED lights fastened or coupled to or otherwise located within the inside of the ring that lights up the ring at nighttime to enable night play and/or play within dimly lit areas. An internally located battery can be charged via a USB power supply port, the disc/goals can use a replaceable battery, induction charging can be used, plugs to power supplies, or others in various embodiments. In some embodiments, flying discs can include a battery that powers integrated or removable LED lights that are ON or flashing during nighttime play The flying disc can comprise a motion-sensitive integrated chip, so that the LED lights are only ON or flashing when being thrown (to save or conserve battery power).

In some embodiments, the flying disc can make an intermittent or continuous electronic "whirring" or "buzzing" or "beeping" sound when thrown and/or being held or carried. Alternatively, the discs can emit a constant and/or variable sound whose frequency (pitch) depends on a speed at which the disc is flying or being carried as sensed by a gyroscope or other sensor of the flying disc. Players may not carry a broom during play. The game can also integrate use of a flying drone instead of a flying disc, and/or players can use a flying drone as the defensive ball. In some embodiments, players can use a bean bag in place of a flying disc. Such a bean bag can be approximately 11 inches in circumference that weighs around 14 ounces. Such a bean bag can have a colorful tail. The game can be played on grass or wood or concrete flooring; indoors or outdoors. In many embodiments, the game is a non-contact game, similar to Ultimate Frisbee™.

BRIEF DESCRIPTION OF THE DRAWINGS

A more complete understanding of the embodiments, and the attendant advantages and features thereof, will be more readily understood by references to the following detailed description, when considered in conjunction with the accompanying drawings, wherein.

DETAILED DESCRIPTION OF THE INVENTION

Figure 1:
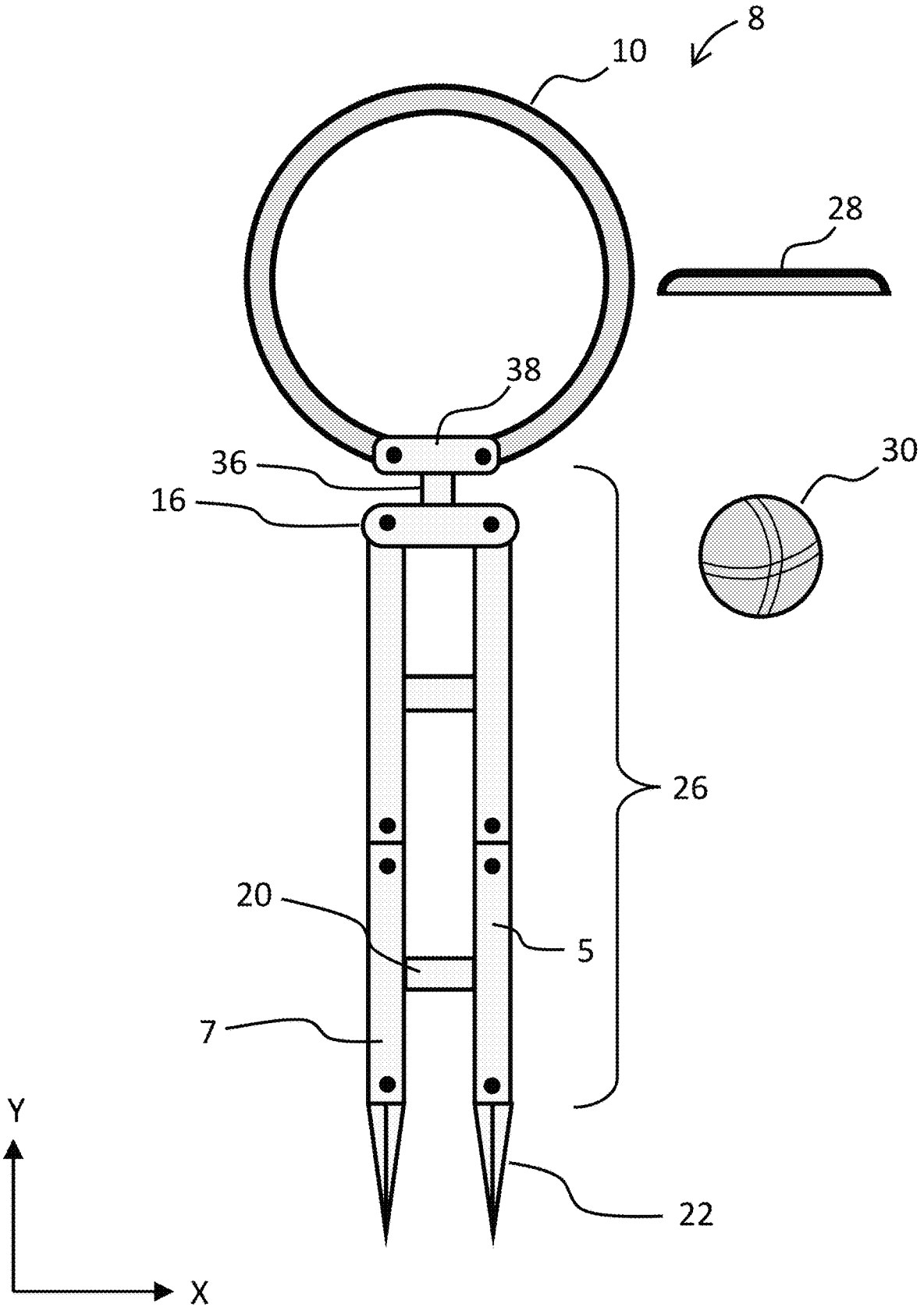
FIG. 1 illustrates an elevation view of a game kit 8 comprising a goal ring 10, a support post 24, a flying disc 28, and a defensive striker ball 30, according to some embodiments of the present invention.

The specific details of the single embodiment or variety of embodiments described herein are set for in this application. Any specific details of the embodiments are used for demonstration purposes only, and no unnecessary limitation or inferences are to be understood therefrom.

Before describing in detail exemplary embodiments, it is noted that the embodiments reside primarily in combinations of components related to the system. Accordingly, the device components have been represented where appropriate by convention symbols in the drawings, showing only those specific details that are pertinent to understanding the embodiments of the present disclosure so as not to obscure the disclosure with details that will be readily apparent to those of ordinary skill in the art having the benefit of the description herein.

Game Equipment

In general, the embodiments described herein relate to a recreational game kit that includes multiple playing devices, including at least one flying disc (preferably 2 discs), at least one defensive striker ball (preferably two striker balls), and at least one set of goals (with preferably three rings per set of goals). The game kit can comprise an even number of flying discs, wherein one-half of those discs are selected to have one color corresponding to one team, and the other one-half of those discs are selected to have a different color than the ones in the first one-half, corresponding to the other team. In particular, the recreational game kit can include two flying discs (e.g., one red and the other green) and two sets of goals (wherein each set of goals comprises 3 same-sized goal rings). The objective of the game is to score points by throwing the flying disc through one of an opposing team's set of goals in order to score points. Two striker balls can be used, which can be identically colored or different. Either striker ball can be used by the opposing (defending) team to knock the incoming flying disc out of the air before it passes through their goal.

In one embodiment, same-sized goal rings can be a standard 27 inches in diameter, and the flying discs can be 21 centimeters in diameter and weigh no more than 175 g. Alternatively, three goal discs can have different diameters, ranging from 21" to 24" to 27". Passing though the smallest diameter rings affords a greater point score than a larger diameter ring.

The game kit can further comprise goal ring support means for holding each goal ring in a fixed, vertically-oriented, elevated position above the ground. A variety of goal ring support means are described later herein.

FIG. 1 illustrates a schematic elevation view of an example of a game kit 8 of individual parts comprising: a goal ring 10; flying disc 28; defensive striker ball 30; ring support stand 26; and metal or plastic "tent" stakes 22 that can be utilized on a grass field. For playing on a hard surface, (e.g., wood floor, concrete floor), the bottom of the support stand 24 can be an "H"-shaped, or circular, or oval weighted-base (See, for example, FIGS. 9-11) Each support stand can be made of plastic, metal (aluminum), wood, natural, synthetic, or combinations of materials. However, those in the art will readily understand that the goal rings can be provided in various shapes, sizes, colors, weight, material, and configurations. The scoring rings 10, 12, 14 can be held or raised above (elevated above) the ground level by a portable stand 26 to an adjustable or fixed height. Each goal ring is oriented vertically with respect to the ground. The goal ring 10 is attached to a top of the support stand 26 with a bracket 16 that is fixed with bolts to a rear bracket 18 (not shown) with a ball joint connection 36, which connects to adjustable ring clamp 38. The support stand 26 can include two parallel vertical poles 5, 7 joined by a H-shaped crossbar element 20 to provide a sufficiently rigid support to the goal stand 26. Rings can hang in some embodiments.

Figure 2:
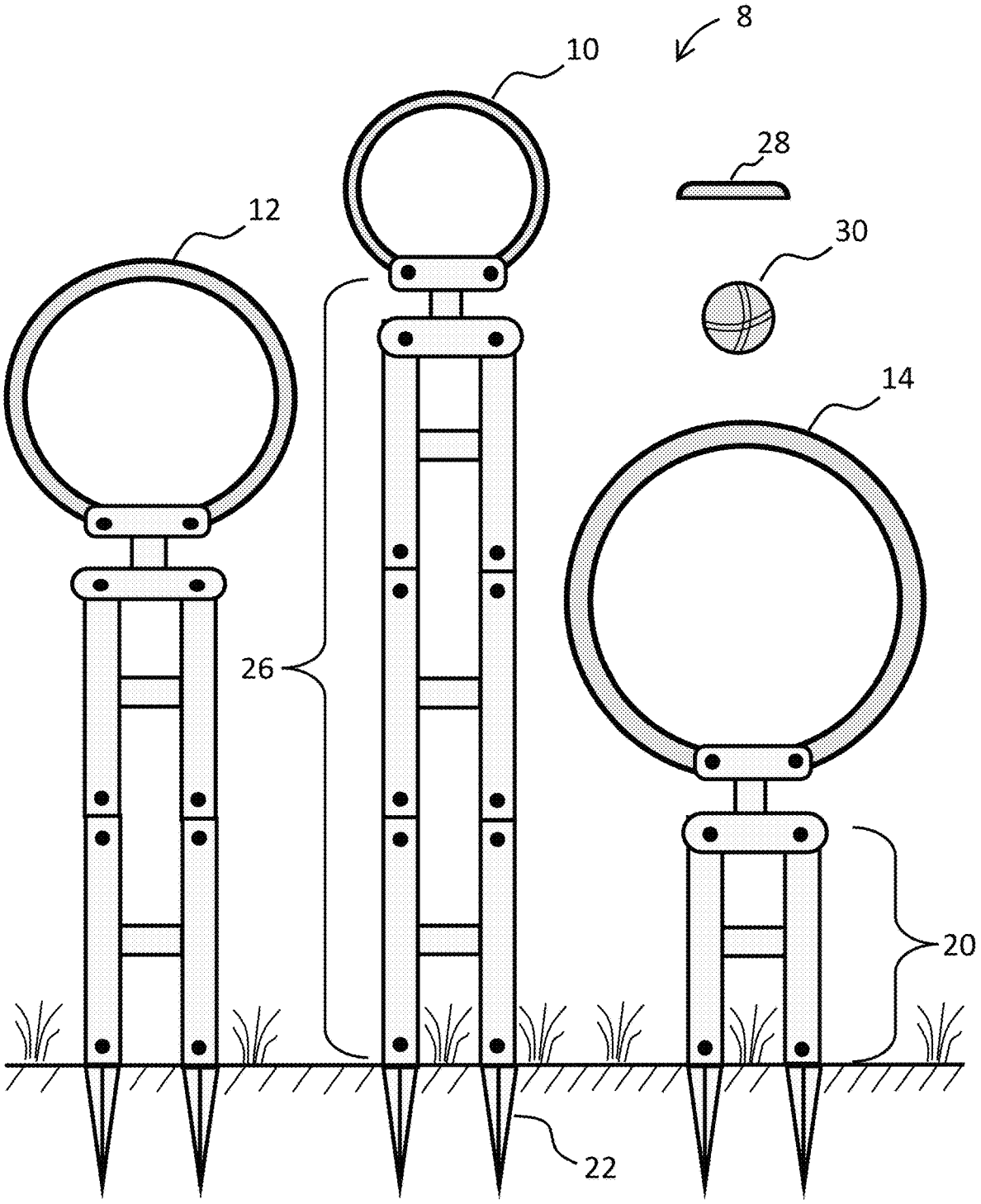
FIG. 2 illustrates an elevation view of a different embodiment of a game kit 8, according to some embodiments.

The height from ground to the top of each goal ring 10 depends on the ring's diameter and the number of H-shaped brackets 20 that are used, so that smaller diameter rings can be located closer to the ground, and larger diameter rings can be located farther away from the ground. (See FIG. 2) Each flying disc and defensive ball can be provided in various known sizes and configurations to perform the tasks discussed herein. The defensive (striker) ball 30 can have a circumference of about 11-12 inches (diameter=3-4 inches), and can be made like a softball, or a small air-filled dodgeball, or a leather-wrapped soft ball. The flying discs 28 can be 8-10" in diameter (preferably 9").

Figure 3:
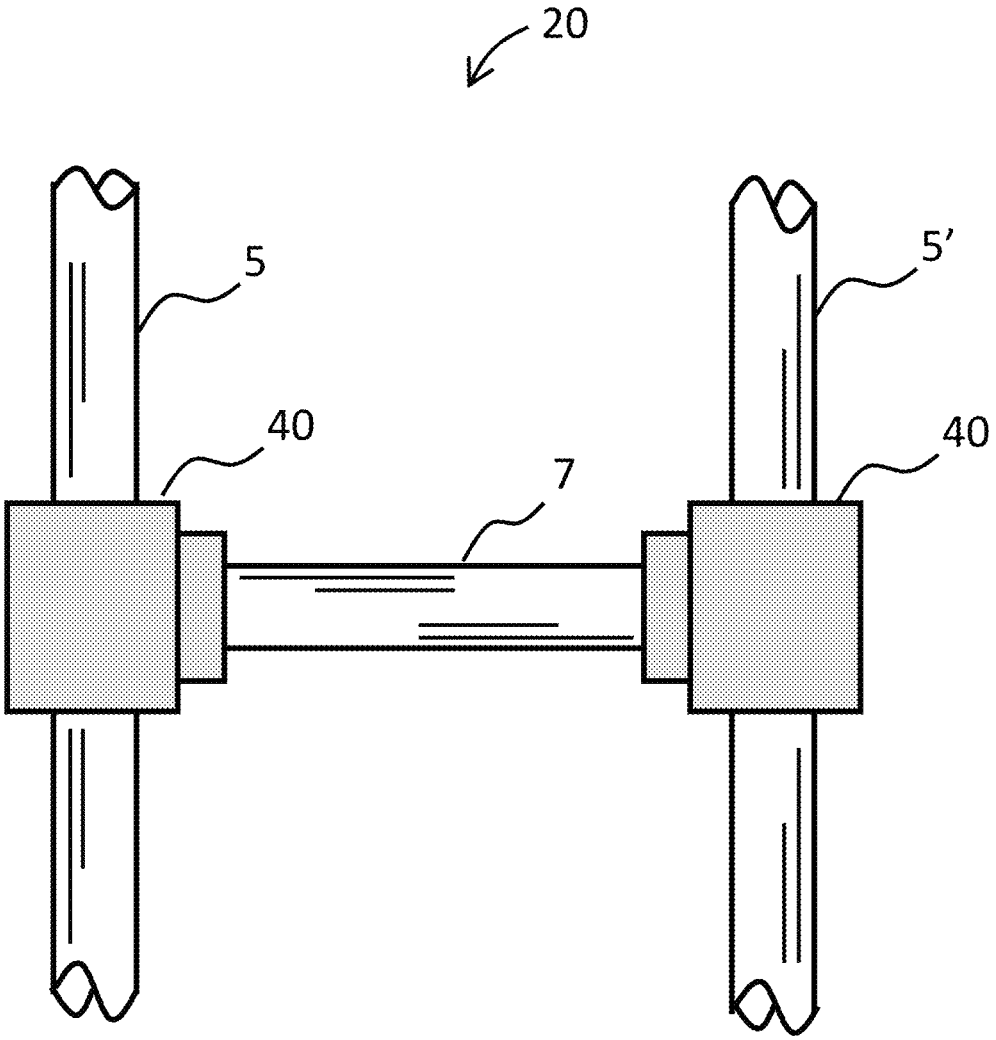
FIG. 3 shows a schematic elevation view of a pair of T-connectors 40 making a "H" joint between two parallel pipes 5, 5', according to some embodiments.

FIG. 3 shows a schematic elevation view of a pair of T-connectors 40 making a "H" joint between two parallel pipes 5, 5', according to some embodiments. The H-shaped crossbar element 20 can be made of plastic (e.g., PVC) pipe, ¾" to 1.5" diameter, with a T-shaped cross-connection joint 40 that is glued or friction-fit together.

In another embodiment, the goal ring 10 can be rotated, and then clamped tight, about the fixed support stand 26 to provide a different configuration of rings pointing in different directions. However, a preferred configuration is that all of the multiple goal rings are pointing in the same direction.

Figure 4:
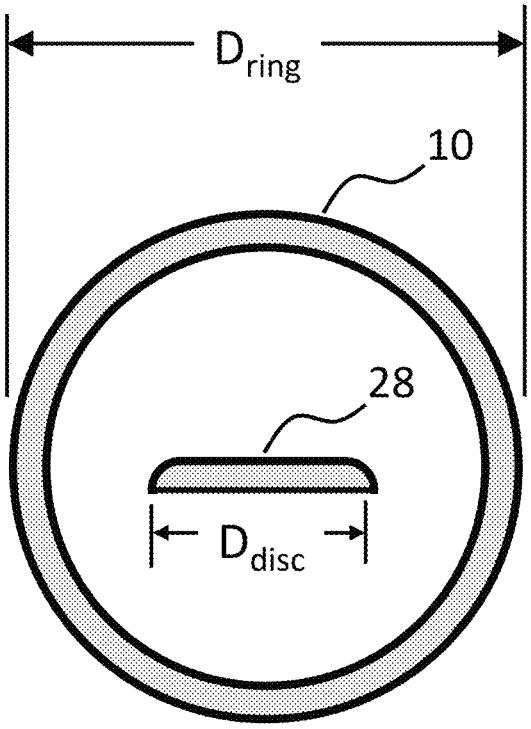
FIG. 4 shows a schematic view of an example of a goal ring 10 and flying disc 28, according to some embodiments.

FIG. 4 shows an elevation view of a flying disc passing through a goal ring. The aspect ratio, R, comprises the diameter of the goal ring, $D_{ring}$, divided by the diameter of the flying disc, $D_{disc}$. ($R=D_{ring}/D_{disc}$). R can range from 2 to 4, depending on the goal ring's diameter.

Figure 5:
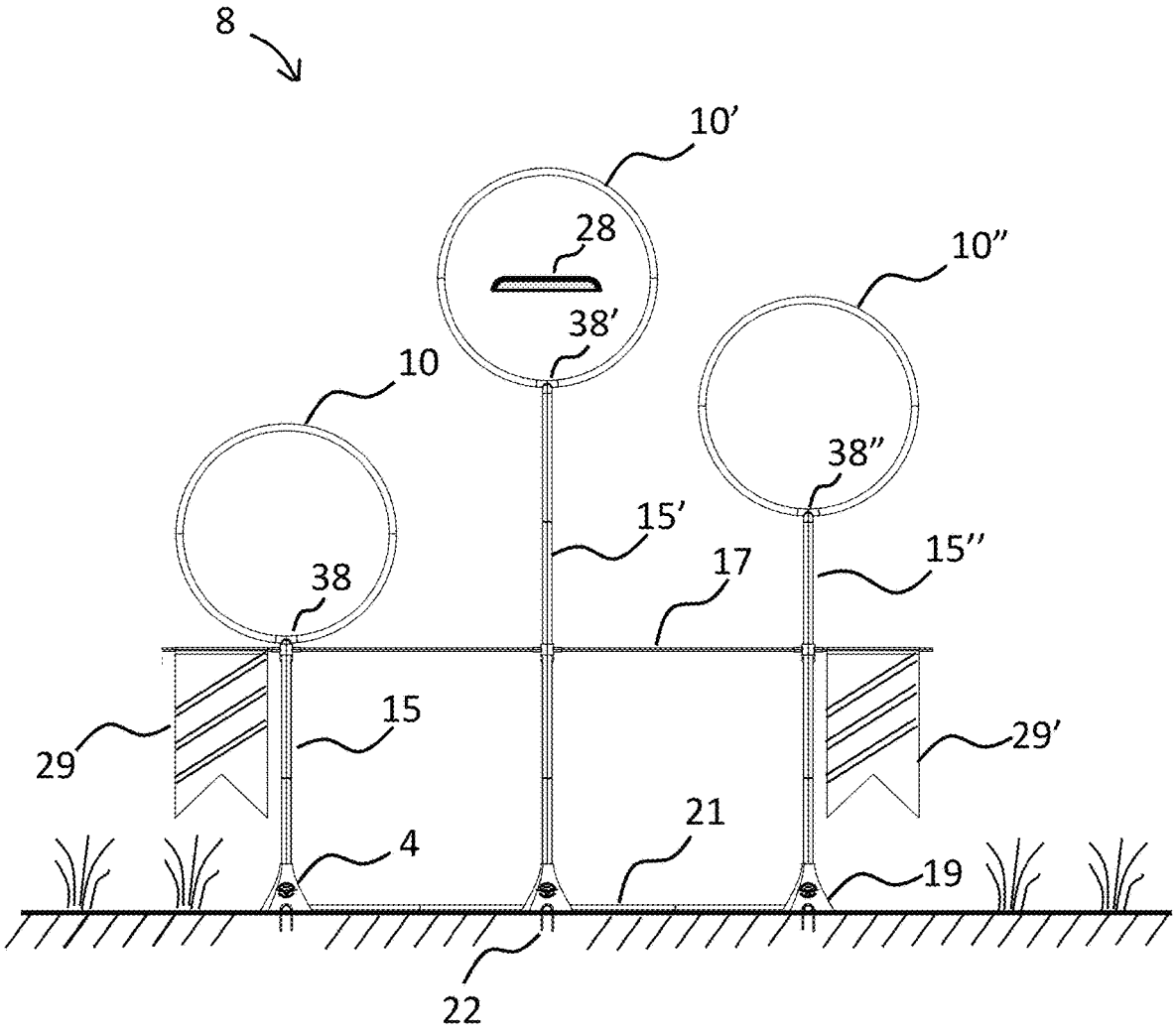
FIG. 5 shows a schematic elevation front view of an example of an assembled set 8 of three identical goal rings, according to some embodiments.

FIG. 5 shows a schematic elevation front view of an example of an assembled set 8 of three identical-diameter goal rings 10, according to some embodiments. The three goal rings 10, 10', 10" are held in place by vertical support posts 15, 15', 15", respectively, by support bracket 38, 38', 38". The three support posts can have different heights, and are connected together by a horizontal pipe 17. Two optional colorful flags 29, 29' hang down from horizontal pipe 17. The bottom ends of the support posts 15, 15', 15" are held by three bottom brackets 19, 19', 19", which can have a logo 4 embossed or attached to the brackets. Bracket 19, 19', 19", are connected together by horizontal pipe 21. An angled support pipe 23 is provided that helps to keep the assembly upright in a vertical orientation. Horizontal support pipes 25, 25' are staked to the ground with U-shaped stakes 22, 22', respectively.

Figure 6:
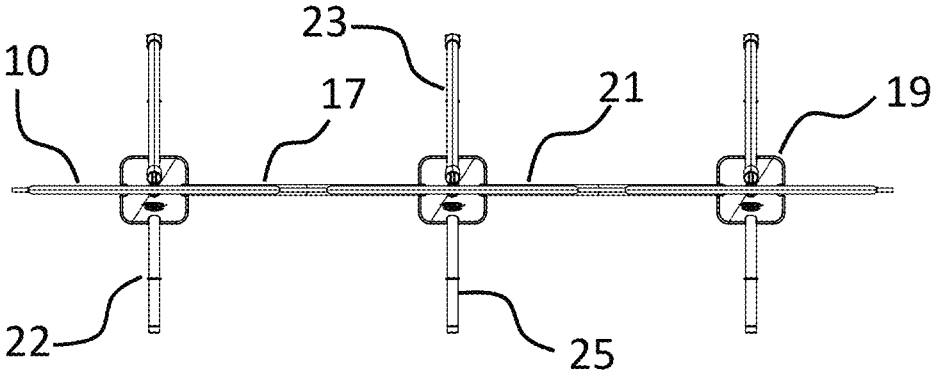
FIG. 6 shows a schematic plan view of an example of an assembled set 8 of three identical goal rings, according to some embodiments.

FIG. 6 shows a schematic plan view of an example of an assembled set 8 of three identical-diameter goal rings 10, according to some embodiments. The three goal rings 10, 10', 10" are held in place by vertical support posts 15, 15', 15", respectively, by support bracket 38, 38', 38". The three support posts can have different heights, and are connected together by a horizontal pipe 17. Two optional colorful flags 29, 29' hang down from horizontal pipe 17. The bottom ends of the support posts 15, 15', 15" are held by three bottom brackets 19, 19', 19", which can have a logo 4 embossed or attached to the brackets. Bracket 19, 19', 19", are connected together by horizontal pipe 21. An angled support pipe 23 is provided that helps to keep the assembly upright in a vertical orientation. Horizontal support pipes 25, 25' are staked to the ground with U-shaped stakes 22, 22', respectively.

Figure 7:
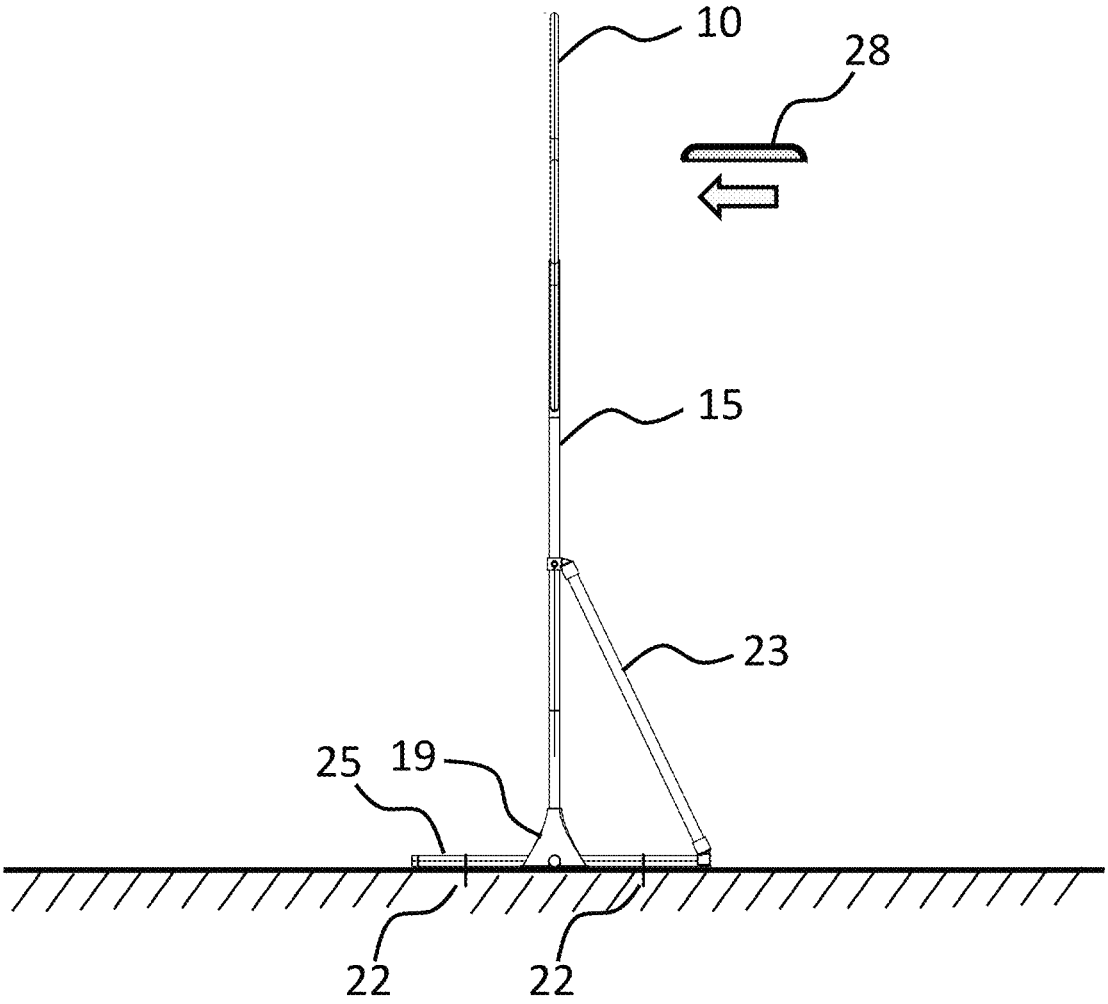
FIG. 7 shows a schematic elevation side view of an example of an assembled set 8 of three identical goal rings, according to some embodiments.

FIG. 7 shows a schematic elevation side view of an example of an assembled set 8 of three identical-diameter goal rings 10, according to some embodiments. The three goal rings 10, 10', 10" are held in place by vertical support posts 15, 15', 15", respectively, by support bracket 38, 38', 38". The three support posts can have different heights, and are connected together by a horizontal pipe 17. Two optional colorful flags 29, 29' hang down from horizontal pipe 17. The bottom ends of the support posts 15, 15', 15" are held by three bottom brackets 19, 19', 19", which can have a logo 4 embossed or attached to the brackets. Bracket 19, 19', 19", are connected together by horizontal pipe 21. An angled support pipe 23 is provided that helps to keep the assembly upright in a vertical orientation. Horizontal support pipes 25, 25' are staked to the ground with U-shaped stakes 22, 22', respectively.

Figure 8:
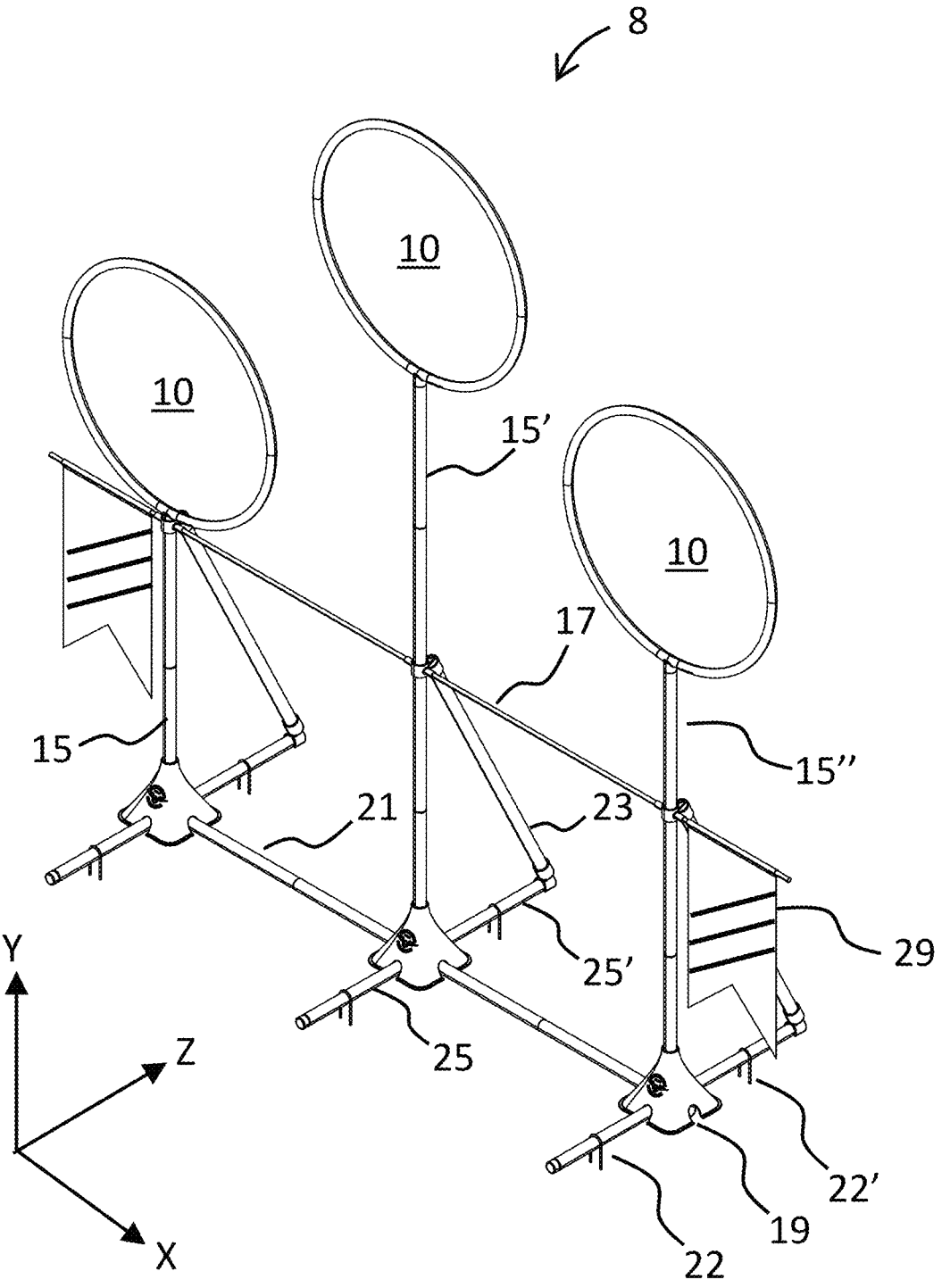
FIG. 8 shows a schematic perspective view of an example of an assembled set 8 of three identical goal rings, according to some embodiments.

FIG. 8 shows a schematic perspective view of an example of an assembled set 8 of three identical-diameter goal rings 10, according to some embodiments. The three goal rings 10, 10', 10" are held in place by vertical support posts 15, 15', 15", respectively, by support bracket 38, 38', 38". The three support posts can have different heights, and are connected together by a horizontal pipe or channel 17. Two optional colorful flags 29, 29' hang down from horizontal pipe 17. The bottom ends of the support posts 15, 15', 15" are held by three bottom brackets 19, 19', 19", which can have a logo 4 embossed or attached to the brackets. Bracket 19, 19', 19", are connected together by horizontal pipe 21. An angled support pipe 23 is provided that helps to keep the assembly upright in a vertical orientation. Horizontal support pipes 25, 25' are staked to the ground with U-shaped stakes 22, 22', respectively.

In FIG. 8, we define a 3-axis Cartesian coordinate system in which the X-axis is parallel to the ground, the Y-axis is perpendicular to the ground plane (i.e. vertically), and the Z-axis is perpendicular to a plane comprising the face of the goal ring 10, 12, or 14 (i.e. horizontally). In other words, a plane of the goal ring across its diameter is perpendicular to the ground plane.

Figure 9:
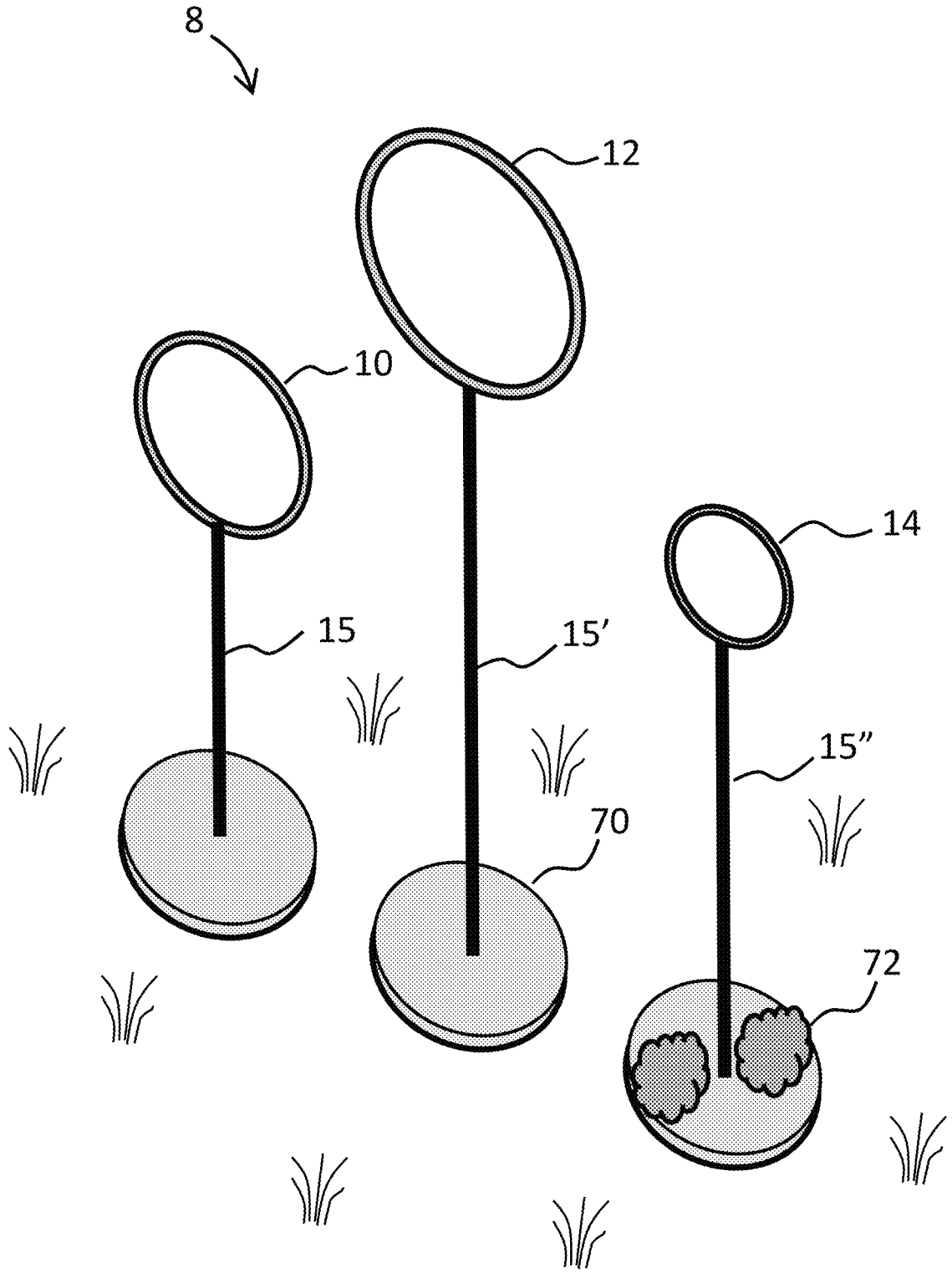
FIG. 9 shows a schematic perspective view of an example of an assembled set 8 of three different diameter goal rings, according to some embodiments.

FIG. 9 shows a schematic perspective view of an example of an assembled set 8 of three different diameter goal rings 10, 12, 14, according to some embodiments. Goal rings 10, 12, 14 are held in a vertical orientation by individual support posts 15, 15', 15" that can have different heights, depending on the ring diameters. A solid, circular base 70 keeps the support posts from falling over in the wind, and can be used for a hard surface (e.g., concrete, asphalt, wood), in addition to a grass field. Optionally, one or more sand bags 72 (or, book bags filled with books) can be used to add weight to the circular base 70.

Figure 10:
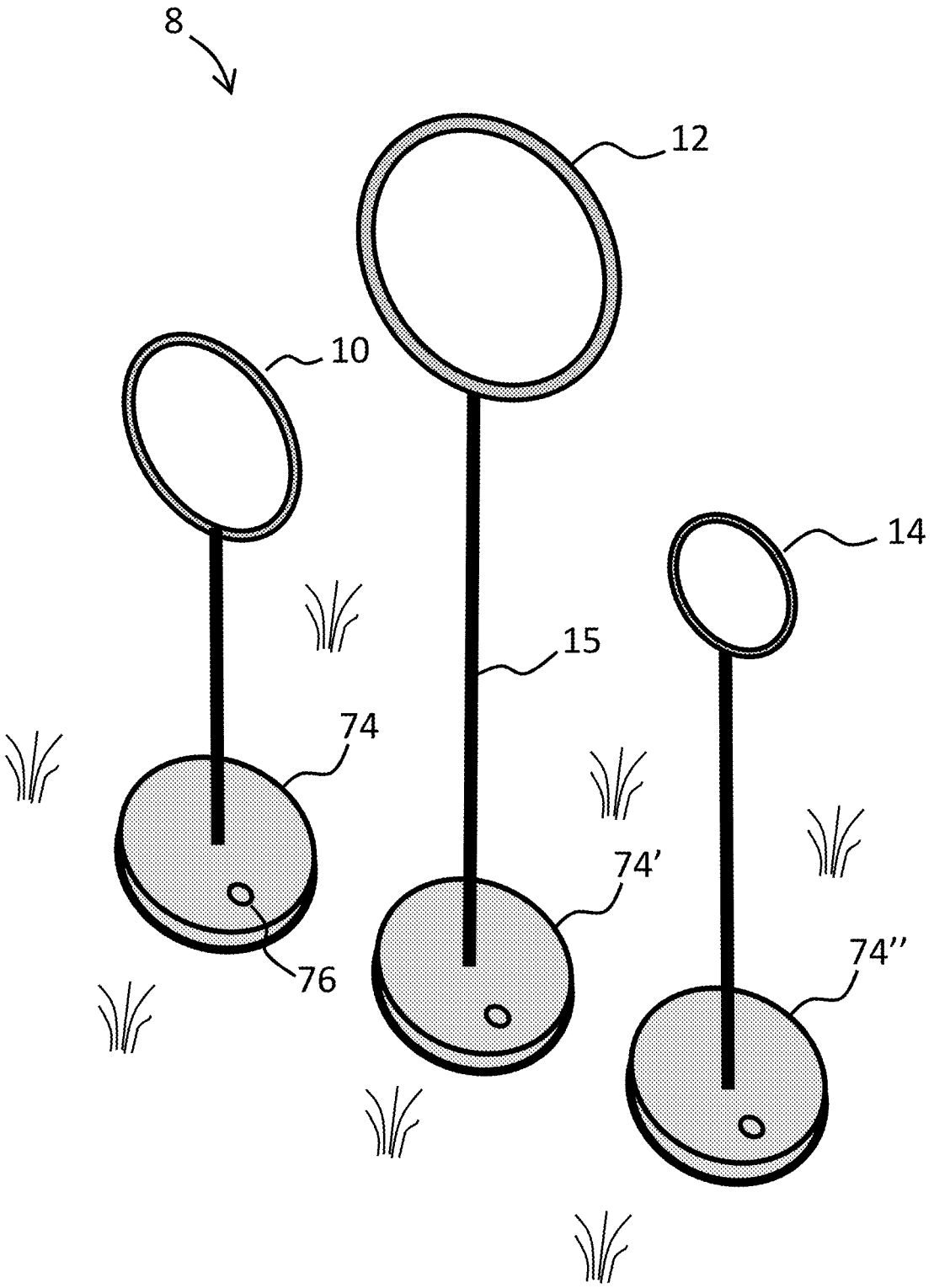
FIG. 10 shows a schematic perspective view of an example of an assembled set 8 of three different diameter goal rings, according to some embodiments.

FIG. 10 shows a schematic perspective view of an example of an assembled set 8 of three different diameter goal rings 10, 12, 14, according to some embodiments. Goal rings 10, 12, 14 are held in a vertical orientation by individual support posts 15, 15', 15" that can have different heights, depending on the ring diameters. A hollow, plastic container base 74 keeps the support posts from falling over in the wind, and can be used for a hard surface (e.g., concrete, asphalt, wood), in addition to a grass field. The container base 74 comprises an opening 76 with a screw cap closure (not shown) that can be used to fill the hollow base 74 with water or sand to increase its weight.

Figure 11:
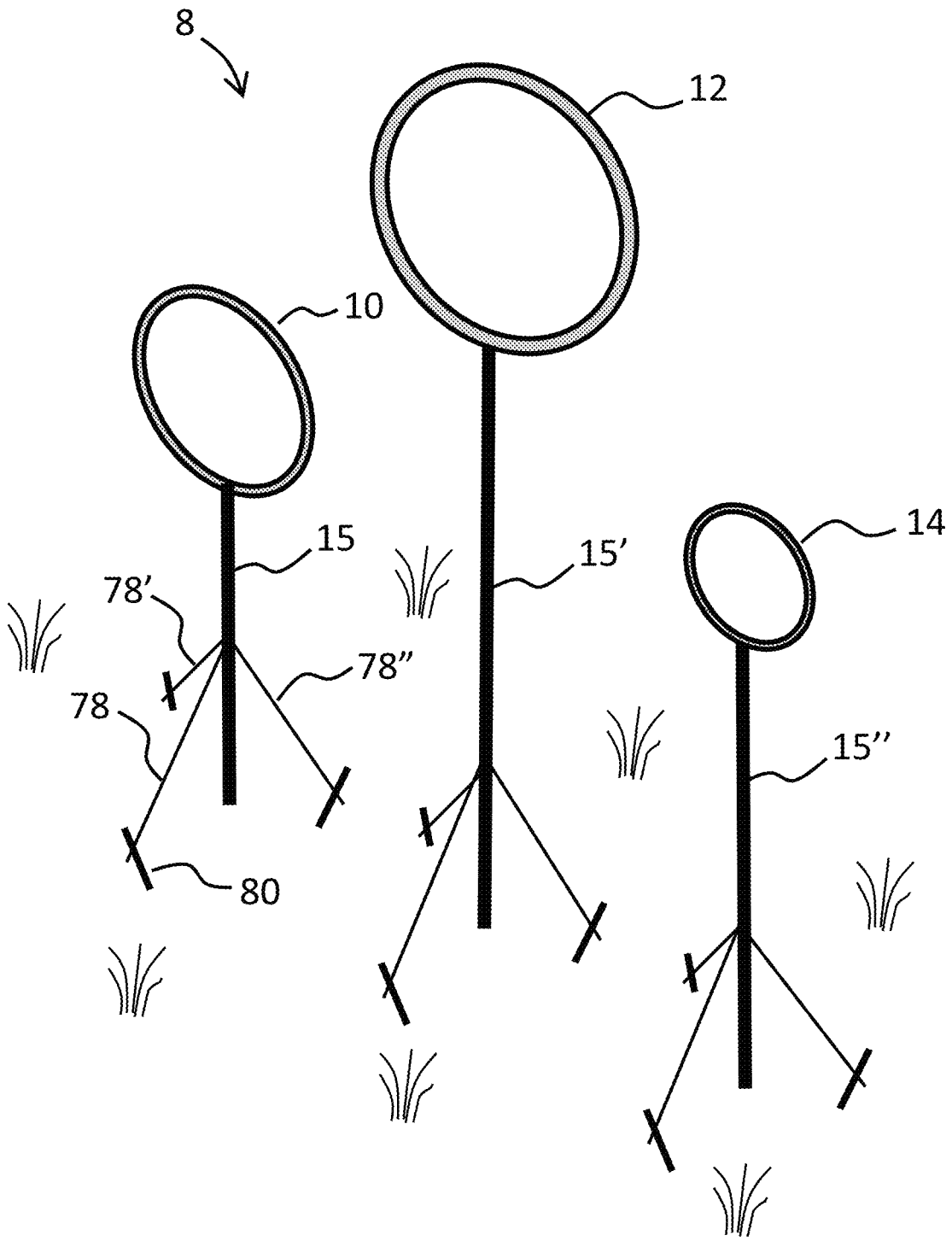
FIG. 11 shows a schematic perspective view of an example of an assembled set 8 of three different diameter goal rings, according to some embodiments.

FIG. 11 shows a schematic perspective view of an example of an assembled set 8 of three different diameter goal rings 10, 12, 14, according to some embodiments. Goal rings 10, 12, 14 are held in a vertical orientation by individual support posts 15, 15', 15" that can have different heights, depending on the ring diameters. Each support post is supported by three guy wires 78, 78', 78" that are fixed to the ground with tent stakes 80, 80', 80", respectively.

Figure 12:
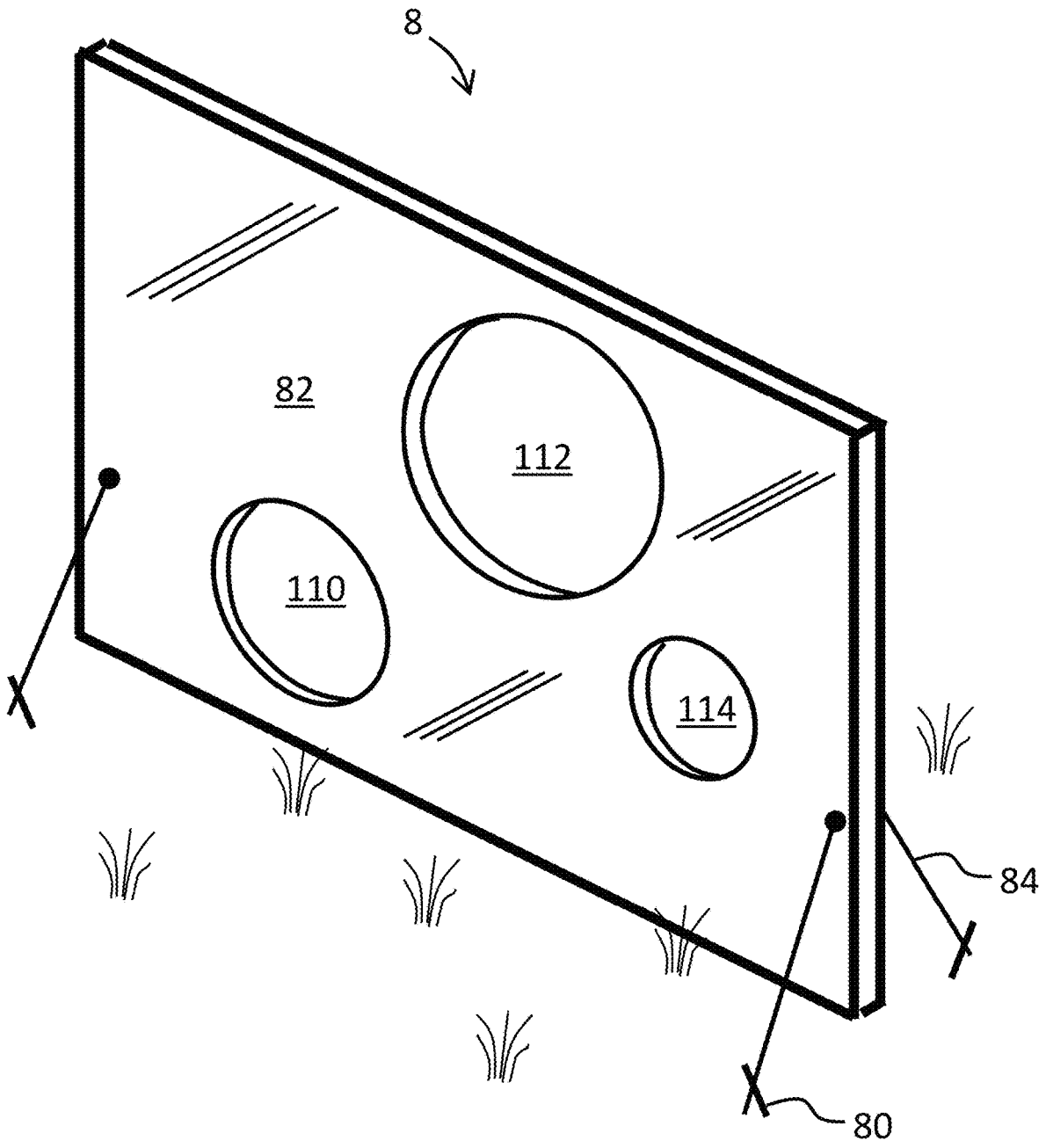
FIG. 12 shows a schematic perspective view of an example of an assembled set 8 of three different diameter goal rings, according to some embodiments.

FIG. 12 shows an alternative goal ring configuration comprising a wood board 82 (e.g., plywood) comprising a plurality of circular or oval apertures 110, 112, 114 corresponding to the shape and size of one or more goal rings 10, 12, 14, and four guy wires 84 and four stakes 80 for holding the wood board in a vertical orientation on a grassy field.

Figure 13:
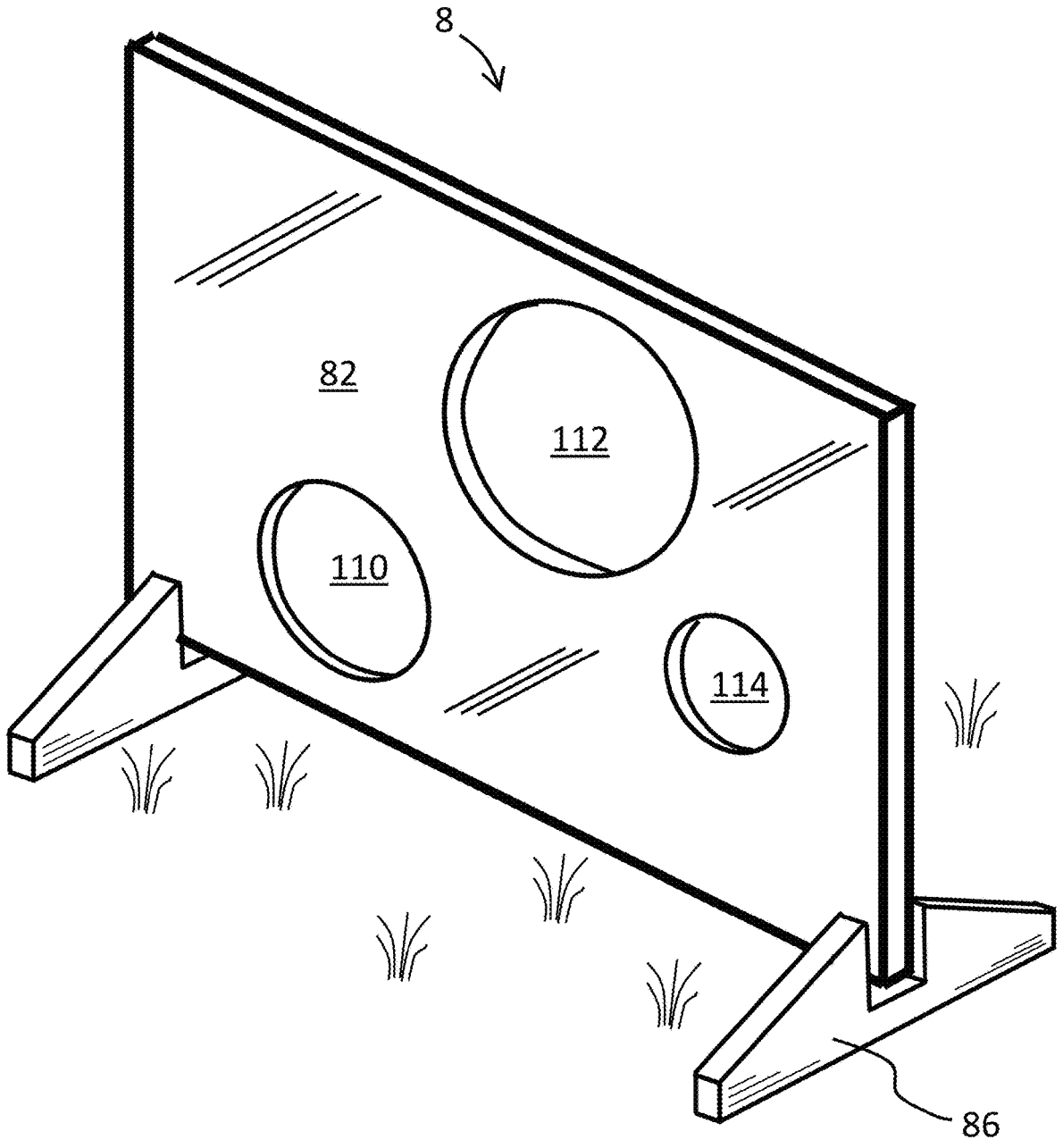
FIG. 13 shows a schematic perspective view of an example of an assembled set 8 of three different diameter goal rings, according to some embodiments.

FIG. 13 shows an alternative goal ring configuration comprising a wood board 82 (e.g., plywood) comprising a plurality of circular or oval apertures 110, 112, 114 corresponding to the shape and size of one or more goal rings 10, 12, 14. Alternatively, the wood board 82 can have removable extended support "feet" 86 can be used to support the board in a vertical direction.

Figure 14:
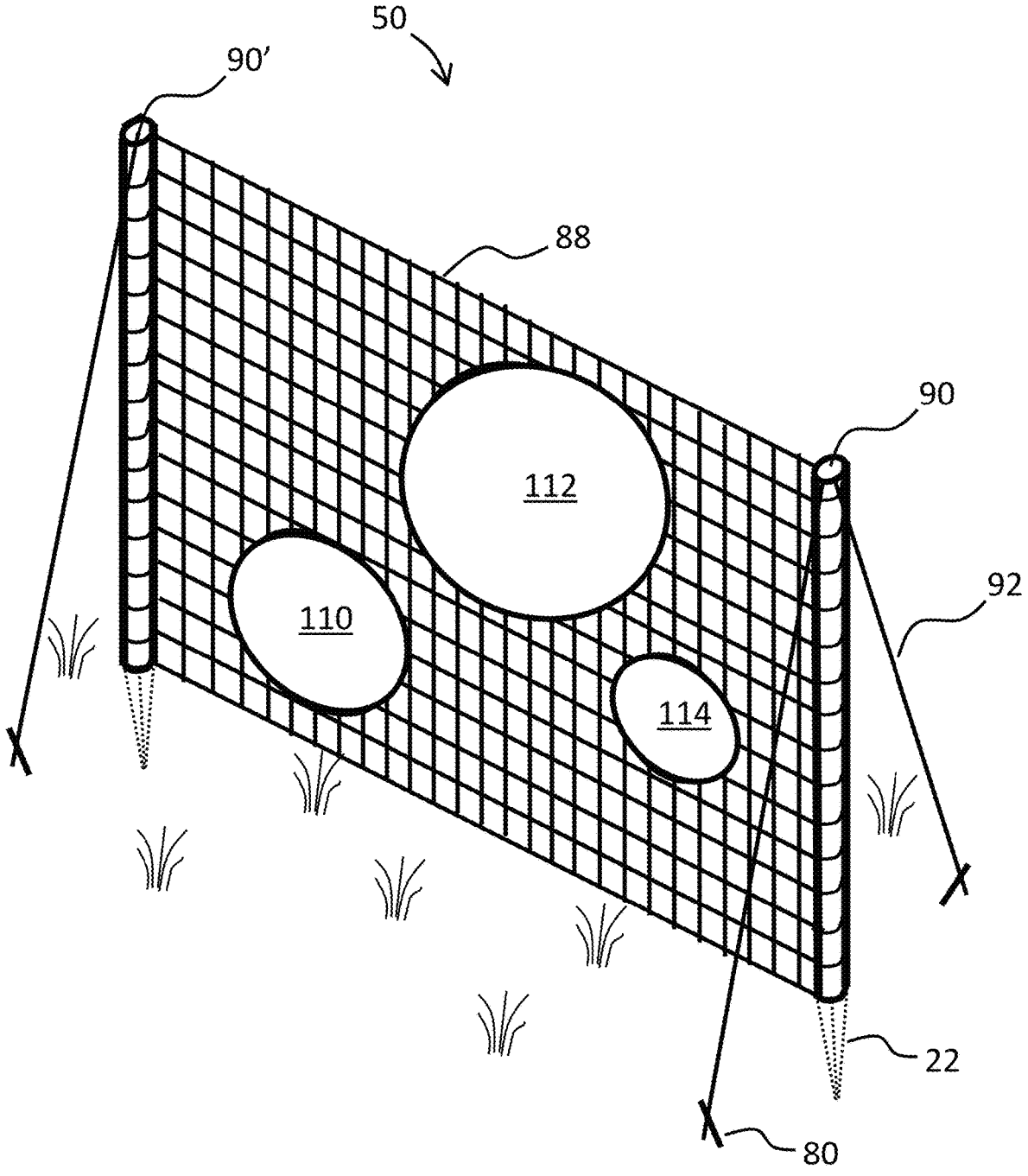
FIG. 14 shows a schematic perspective view of an example of an assembled set 8 of three different diameter goal rings, according to some embodiments.

FIG. 14 illustrates a schematic perspective view of a different embodiment of a set 50 of goal rings. In this embodiment, goal set 50 comprises a flexible, synthetic, woven, open square mesh or grid 88 that is tightly strung between two vertical posts 90, 90' that are supported by four support (guy) wires 92, 92', 92", and 92'" that are staked to the ground with 4 tent stakes 80. The flexible mesh 88 can be attached to the vertical posts 90, 90' with permanent ZipLock™ ties or removable/adjustable Velcro™ ties (not shown). Alternatively, the mesh 88 can have each vertical support pole 90, 90' alternatively threaded through the mesh 88 in a vertical direction. One or more (preferably three) openings/apertures 110, 112, 114 are cut out of the mesh 88 and secured (woven) in such a way as to form a circular or oval opening for the flying disc to pass through. The diameters of the apertures 110, 112, 114 and their positions relative to each other, can be selected to match the diameters and positions of goal rings 10, 12, 14 as shown previously in FIG. 1-13.

Figure 15A:
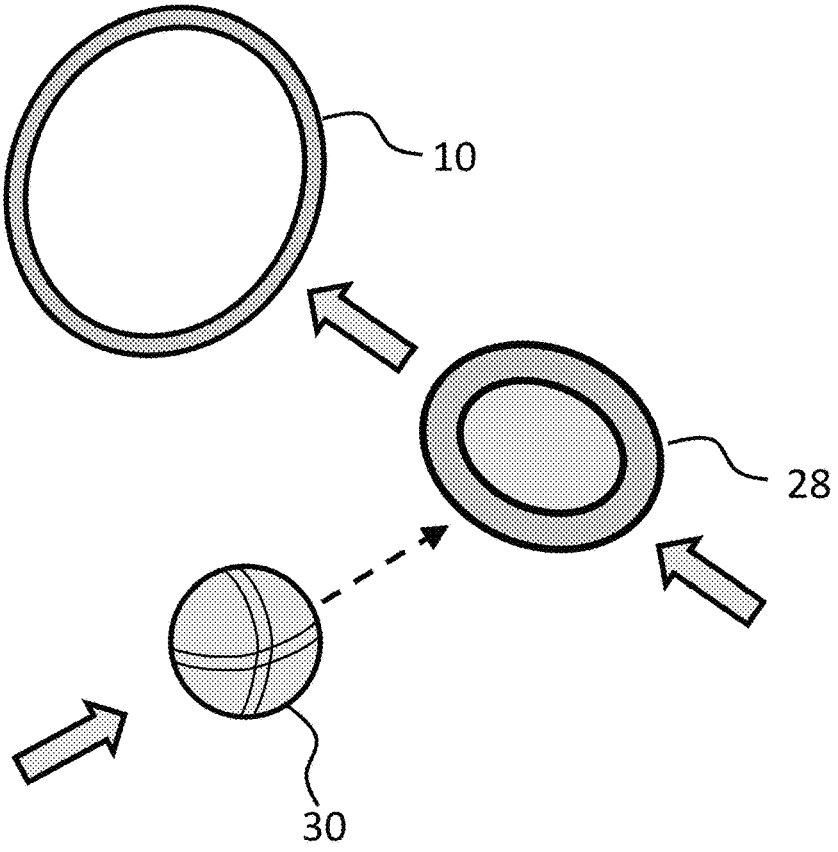
FIGS. 15A-B illustrate a schematic perspective view of throwing a flying disc towards a goal ring, and then of playing defense by hitting the disc with a defensive striker ball to knock it out of the air, according to some embodiments.
Figure 15B:
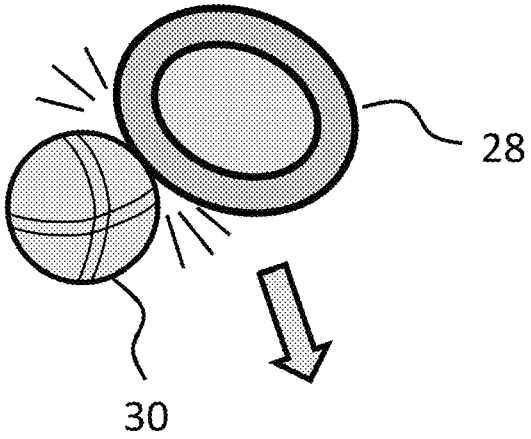

FIGS. 15A-B illustrate a schematic perspective view of throwing a flying disc 28 towards a goal ring 10, and then of playing defense by hitting the disc 28 with a defensive striker ball 30 to knock it out of the air, according to some embodiments. Each player will throw the flying disc 28 in an attempt to pass the disc 28 through the opening of the ring 10, 12, 14. While the disc is flying in the air, an opposing player(s) can throw the striker ball(s) at the flying disc 28 in an attempt to knock it out of the air and prevent the disc 28 from passing through a ring 10, 12, or 14.

Figure 16:
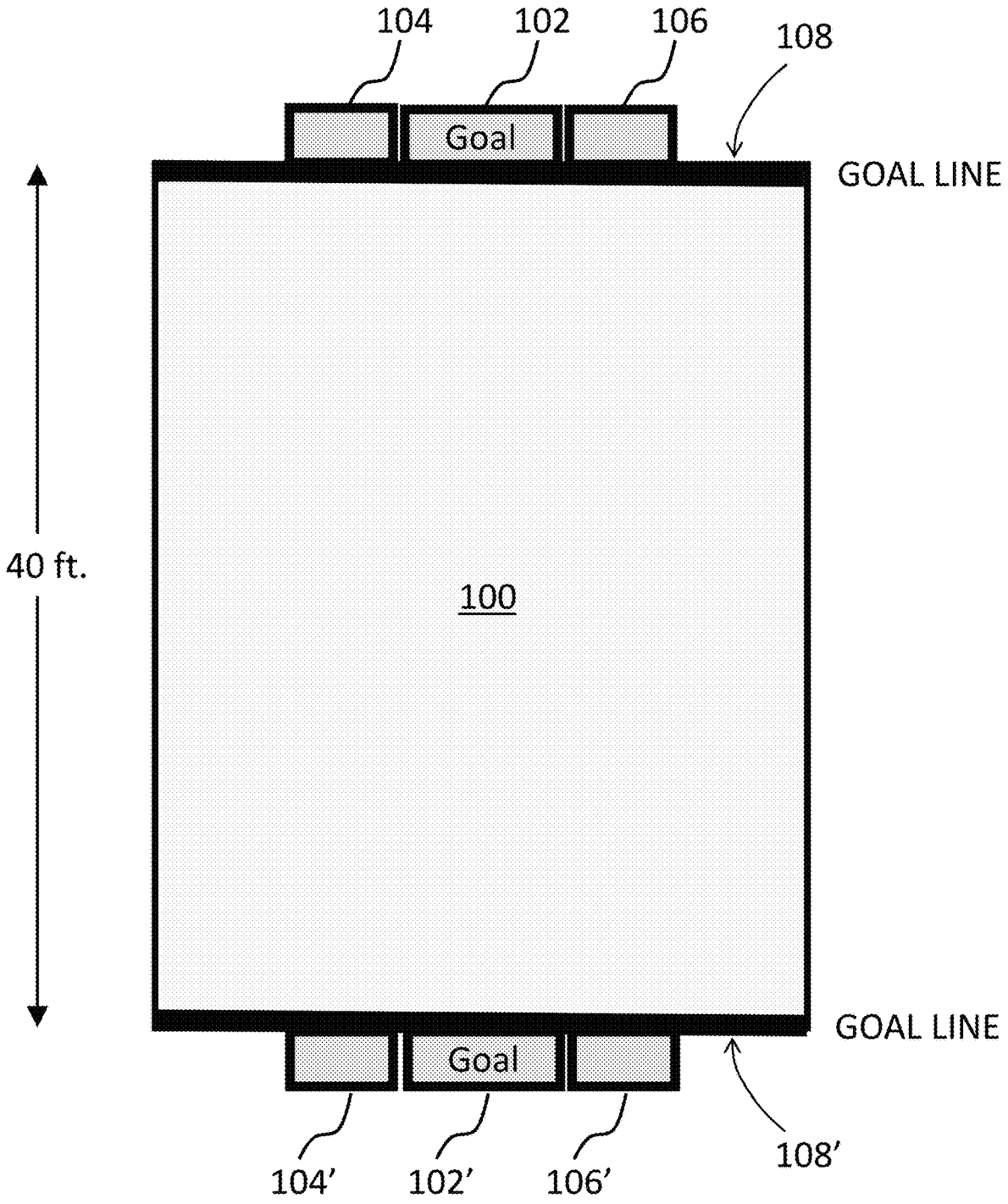
FIG. 16 illustrates a schematic bird's eye view of a rectangular playing area, according to some embodiments.

FIG. 16 illustrates a schematic elevation view of the playing area 100, according to some embodiments. The playing area 100 is preferably rectangular in shape, although other shapes may be used (such as circular, See FIG. 17). The playing area 100 is set up on a level playing surface to avoid an undue advantageous position for either team. One skilled in the arts will readily understand that the field's pitch (the distance between each set of goal rings) may be changed to accommodate players of different skill levels. A preferred pitch is 40 feet long and 20 ft. wide. Playing area 100 (i.e., the "pitch") comprises a pair of goal ring sets 102, 102', that are disposed at opposite ends of the pitch. The goal rings may be mounted on a support stand (not shown) such that the largest ring is on one side and the smallest ring is on the opposite side of the same set. The opposing goal set may be mirrored such that each team has the same view of the rings (e.g., 1 large ring and 2 small rings). A striker ball "throwing box" 106 is shown on either side of the set of goal rings 102, 102'. A pair of foul lines 108, 108' are disposed at both far end lines of the playing field 100. When on offense, the throwing box 104, which can be about 3 ft.×6 ft, can be also called a "Chaser's Box". When on defense, the throwing box 106, 106' can be called a "Beater's box".

Figure 17:
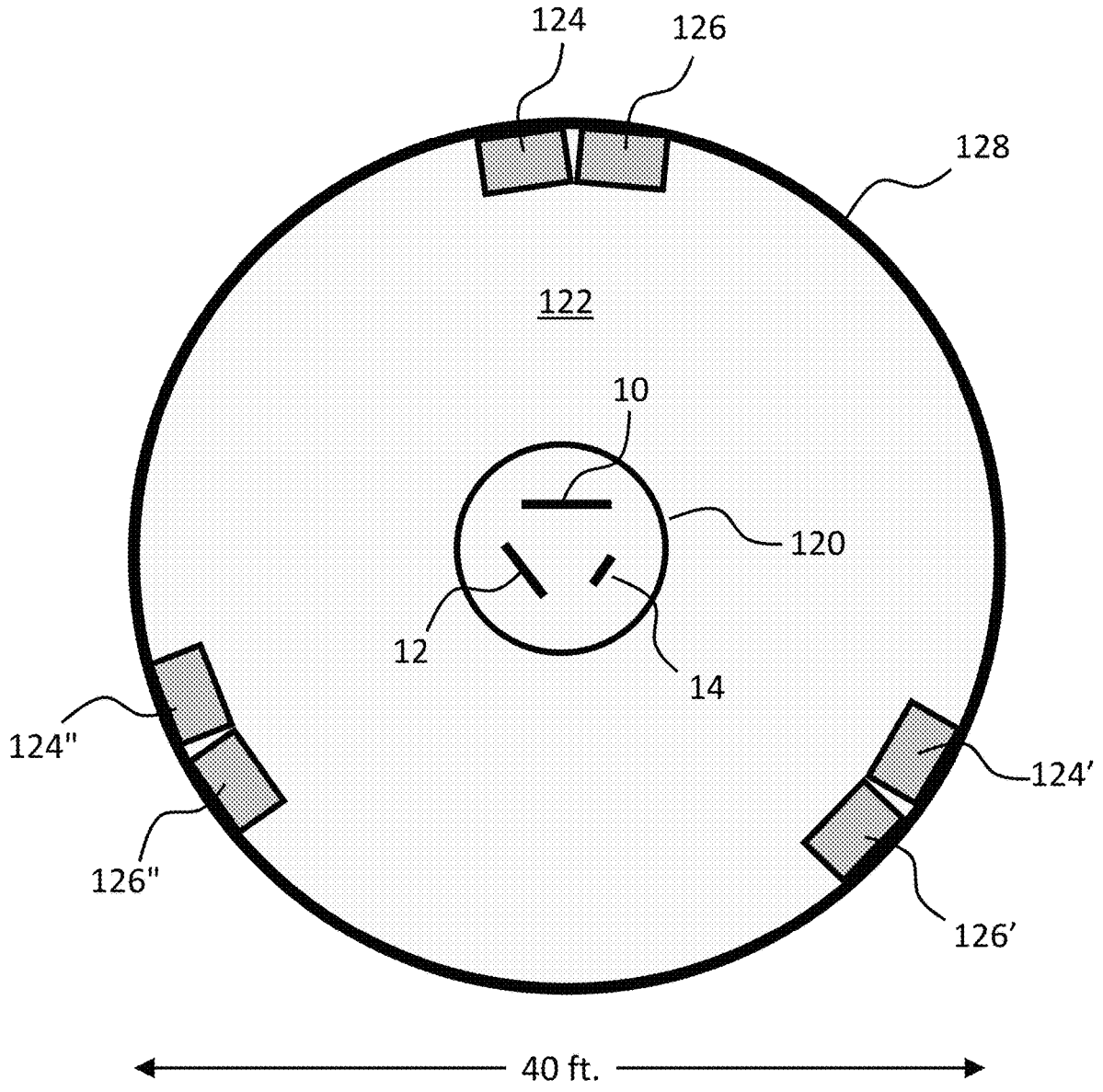
FIG. 17 illustrates a schematic bird's eye view of a circular playing area, according to some embodiments.

FIG. 17 illustrates a schematic bird's eye view of a circular playing area 122, according to an alternative embodiment. Goal rings 10, 12, 14 are placed at the center of the circular area 122, facing outwards from the center. A circular foul line 120 closely surrounds the three goal rings 10, 12, 14. A Thrower's box 124, 124', 124" and a Beater's box (defensive ball thrower) 126, 126', 126" are located on the outer circumference 128 of circular field 122. The outer circumference 128 also serves as the outer foul line 128.

In some embodiments, game matches can be played with at least two flying discs, two sets of goals (three rings in each set of goals) at least two striker balls, and at least four players. Each game set can include two flying discs. Each flying disc can be distinguishable from the other, such as by using different colors for each disc or set of discs. The discs can be regulation size flying discs (e.g., 8 to 10 inches in diameter and no more than 175 g in weight). One skilled in the arts will readily understand that various sizes and configurations of flying discs may be utilized.

In some embodiments, each set of goal rings can consist of three goal rings. The rings (which may also be referred to herein as "hoops") can have standard sizes of 30 inches, 25 inches, and 20 inches in diameter, respectively. The smallest diameter (e.g., 20-in) hoop can be attached to the tallest pole (e.g., 6 feet in height), the medium diameter hoop (e.g., 25-inch) can be attached to a medium height pole (e.g., 4.5 feet in height), and the largest diameter hoop (e.g., 30-inch) can be attached to a shortest pole (e.g., 3 feet in height). Each pole can be spaced apart a set distance, (e.g., S=36 inches), apart from each other. One skilled in the arts will readily understand that the aforementioned dimensions are for exemplary purposes only and may be changed to vary the degree of difficulty and general dynamics of the game. For example, the number of rings in a goal set can range from 1 to 3 rings per goal set, or more.

Each different diameter ring provides a varying degree of difficulty. The act of scoring (e.g., such as by throwing the flying disc through one of the rings) corresponds to a point value. Point values may change based on the difficulty of throwing the flying disc through each ring. Alternatively, depending on the field's setup, discs can be thrown through a goal ring in either direction (uni-directional or bi-directional) through the front side or the backside of the ring. This alternative feature could be used, for example, in conjunction with a circular playing area.

In some embodiments, the defensive striker balls may be constructed of a soft material (e.g., leather) and may be about 12 inches in circumference (Diameter=3-4 inches). Alternatively, the striker ball and the flying disc could be both, or either, made of bean bags. Since bean bags don't "fly", the field's pitch may need be shrunk considerably (i.e., to a "backyard" size).

In some embodiments, the playing area can have a standard distance of 40-feet between the sets of goals (i.e., each set of goal rings are positioned 40-feet apart). In some embodiments, shorter distances and heights can be used when younger players are participating, or if there is not sufficient room for a "standard" field of play.

In some embodiments, the flying discs 28 are tossed from a designated region 86 within the playing area. A "throwing box" 86 may be defined within the designated region wherein the players must stand within while throwing the flying discs. Players cannot block the throwing of the flying disc by an opposing player (as is done in Ultimate Frisbee™). In some embodiments, each box 86 may be located directly to the left or right of a platform 41 (which is a rectangular area that surrounds the set of goal rings, and which can be raised up 2-4" in a permanent playing area). On defense, these throwing boxes 86 define a defensive player's standing area wherein they must throw the striker ball(s) from. The baseline of the goals forms a foul line 84.

Playing Rules

In some embodiments, the game may be known as "Backyard Quidditch", and matches can be broken down into frames of play. During each frame, every player throws their discs or bean bags. The team that scored last will have honors and throw first on each turn. A player must throw the discs from either the left or right Chaser's Box and remain in that designated box for the duration of the match in doubles or crew. This rule also applies to the tossing of the defensive striker balls or bags in defense of the goals. They are to be tossed from the designated box for the duration of the match. In singles play, a player will throw from both the right and left Chaser's Box during the game as the players walk down to retrieve their discs/bags in their designated lane. At no time will opponents throw from the same pitcher's box during a frame.

Players may not step over the foul line or outside of the Chaser's Box while throwing. The penalty for a first foul is the loss of one defensive striker turn. A second offense is the loss of two striker turns, third offense, three striker turns. Any additional fouls for a single team will continue to be a three-turn penalty for the defensive strikers, Note: a foul can occur in throwing the disc or the striker. Both count towards the team penalty.

The player who scored in the preceding frame throws first in the next frame. If neither player scores, the player who threw first in the preceding frame throws first in the next frame. Note: No foot can land past the front of the goals until the disc leaves the hand, otherwise the point does not count.

"Backyard Quidditch" can be played as singles, doubles, or crew format (4 players to a team). In doubles play, four players split into two teams. One member from each team throws from one goal set and the other members throw from the other. In singles play, two players play against each other and there is no defensive component to the game. Delivery is handled in the same manner as doubles play. Both players throw from the same goal set to complete the frame.

In crew format, each end of the pitch consists of two players from each team, with eight total players (4 per team). Players will each throw one disc/bag per frame in alternating fashion. In this configuration, there are four discs or bean bags per frame being thrown at the goal sets—two for each team, one by each player. There are also four defensive "strikers" being tossed in this format as well—two per team per frame. All members of the crew must toss the striker balls—they may not "double up" simply because a player may be better than another.

Standard Hoop Scoring:

In order to score in the standard format, the discs/bags must be tossed through one of the three goal hoops at either end of the pitch. A disc/bag; that flies through any hoop is worth 10 points. If a disc/bag touches the goal and goes through the hoop, it counts for that corresponding hoop point total. If a team on defense is able to connect with a disc/bag when tossing a defensive striker ball, they will receive an additional 5 points for their total score even if the affected disc/bag then goes through the hoop for the offensive team.

Alternative Hoop Scoring:

When using the varied sized hoops, a disc/bag that flies through the smallest hoop is worth 15 points, through the mid-sized hoop is worth 10 points, and through the largest hoop is 5 points. Defensive scoring remains the same.

Scoring Methods:

Standard scoring is done by simply totaling the team's points for each turn, including defensive points, until the first team reaches 150 points. The second method for those who prefer it is done by cancellation (e.g., if Team A scores 15 points in the frame and Team B scores 5 points in the frame, Team A is awarded 10 points). So it would be understood that only one player/team can register points in a given frame and therefore ties are not a possibility. Play continues until a player or team reaches 100 points in this format. The winning team must reach exactly 100 points. If, for example, a team has 95 points and throws a disc through the 10 point goal, the points are not allowed and the team remains at 95 points. The winning team does not need to win by any established number of points.

Either of these scoring methods can be used when using the standard hoops or the alternative hoops, the discs or the bags.

In some embodiments, the ring's diameter may be adjustable (e.g., tube-in-tube slip joint), or the set of playing materials may come with various additional rings sizes to make gameplay easier or harder based on preference. The design of the ring support stand ring bracket shown in FIG. 1 can easily support rings of modestly different diameters.

In some embodiments, scoring may be maintained on an automated scoring board via an automated scoring system. The scoring system may be in communication with one or more sensors positioned on each ring. For example, the sensors may be positioned to sense a disc passing through the ring and emit an output signal to a scoring module in communication with a computing processor.

In some embodiments, each ring can include a lighting element, such as an LED strip placed at least partially around a circumference of a ring. The LED lighting element may be in communication with the sensor(s) such that the scoring light (and/or or an audible scoring sound) turns ON once the flying disc passes through the ring. In such a way, players are alerted to when they have successfully scored. The scoring light (and/or scoring sound) can be intermittent (e.g., flashing), wherein the number of flashes (1, 2, 3) repeats over a period of time (e.g., 3 seconds) is controllable by a controller to indicate which of the three goal rings (small, medium, large) was scored upon. For example, the scoring light quickly flashes 3 times for scoring through the small diameter ring; 2 times for the medium diameter ring; and 1 times for the large diameter ring. The entire flashing sequence repeats itself after about 5 seconds, for a total of 5 cycles, at which point the flashing sequence stops completely. The scoring module can display the total score for each team.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. A recreational game kit, comprising:

at least two flying discs;

at least two sets of goal rings; and at least two defensive striker balls;

wherein an offensive player scores by throwing the flying disc through one of the goal rings; and wherein a defensive player throws a striker ball at a flying disc as a defensive action to prevent the flying disc from passing through one of the goal rings.

2. The game kit of claim 1, wherein the at least two flying discs have different colors, which is used for distinguishing between different teams.

3. The game kit of claim 1, further comprising a plurality of individual support stands, one stand per goal ring, for holding each goal ring in a fixed, elevated position above the ground in a vertical orientation with respect to the ground.

4. The game kit of claim 1, wherein a first set of goal rings is positioned at one end of a playing field, and a second set of goal rings is positioned at an opposing end of the playing field.

5. The game kit of claim 3, further comprising a plurality of brackets that attach a bottom of the goal rings to a top of each individual support stand.

6. The game kit of claim 3, wherein the support posts further comprising a base element selected from the group consisting of an H-shaped base, a circular-shaped base, an oval-shaped base, and a hollow plastic box filled with sand or water.

7. The game kit of claim 1, Wherein each set of multiple goal rings comprises three rings of different diameters (small, medium, and large), and three support posts of three different heights (small, medium, and tall), wherein a ring with the smallest diameter is attached to the tallest support post, and a ring with the largest diameter is attached to the shortest support post.

8. The game kit of claim 1, wherein an aspect ratio, R, equal to a diameter of a goal ring, $D_{ring}$, divided by a diameter of a flying disc, $D_{disc}$, ranges from 2× to 3× (200% to 300%).

9. The game kit of claim 1, further comprising a scoring system in operable communication with one or more position sensors located on each ring; wherein the sensors are positioned to sense a flying disc passing through the ring, and whereby a scoring signal is sent to a scoring module that is in operable communication with a computing system that calculates and displays the current team's scores.

10. The game kit of claim 1, further comprising a right and left thrower's box disposed on a playing field adjacent to the set of goal rings, wherein an offensive player stands within the box and throws the flying disc at the goal rings, or a defensive player throws the striker ball at a flying disc in an attempt to knock down the disc.

11. A method of playing a recreational game, comprising:

(a) providing a recreational game kit comprising:

at least two flying discs;

at least two sets of multiple goal rings; and at least two defensive striker balls;

(b) scoring one or more points by an offensive player throwing a flying disc through one of the goal rings; and (c) further comprising a defensive player throwing a striker ball at a flying disc as a defensive action to prevent the flying disc from passing through one of the goal rings.

12. The method of claim 11, wherein an offensive player starts playing by throwing a flying disc towards a set of multiple goal rings located on a far side of a playing field; wherein each of two teams of offensive players take turns throwing the flying disc towards a goal ring; and awarding the most points to passing the disc through a goal ring having a smallest diameter.

13. The method of claim 11, wherein each player does not use or carry a broom or a broom stick while playing a game.

14. The method of claim 11, further comprising detecting when a flying disc passes through a goal ring by using an automated scoring board using an automated scoring system, and further comprising emitting a flashing sound and/or light signal from the automated scoring system when the flying disc passes through a goal ring.

15. The method of claim 11, wherein a player who scored most recently throws first in a next frame.

16. The method of claim 11, further comprising the offensive player throwing the flying disc from either a left or right throwing box disposed next to offensive player's own set of goal rings; and wherein the offensive player remaining in that designated throwing box for the duration of the match.

17. The method of claim 11, further comprising the defensive player throwing the striker ball from either a designated left or right throwing box; and wherein the defensive player remaining in that designated throwing box for the duration of the match.

18. The method of claim 11, wherein each team player uses their own flying disc, which is colored a different color from an opposing team player's disc color.

19. The method of claim 11, further comprising turning on a flashing scoring light, or emitting a repeating sound, when the flying disc passes through a goal ring.

* * * * *